US009764179B2

(12) United States Patent
Prats

(10) Patent No.: US 9,764,179 B2
(45) Date of Patent: Sep. 19, 2017

(54) EXERCISE APPARATUS HAVING A TARGETED FLUID SUPPORT SYSTEM

(71) Applicant: Tristar Products, Inc., Fairfield, NJ (US)

(72) Inventor: Jorge Prats, River Edge, NJ (US)

(73) Assignee: Tristar Products, Inc., Fairfield, NJ (US)

( * ) Notice: Subject to any disclaimer, the term of this patent is extended or adjusted under 35 U.S.C. 154(b) by 0 days.

(21) Appl. No.: 15/019,911

(22) Filed: Feb. 9, 2016

(65) Prior Publication Data

US 2016/0263418 A1 Sep. 15, 2016

Related U.S. Application Data

(60) Division of application No. 13/356,468, filed on Jan. 23, 2012, now Pat. No. 9,254,404, which is a continuation-in-part of application No. 13/113,029, filed on May 20, 2011, now Pat. No. 8,784,277.

(60) Provisional application No. 61/568,619, filed on Dec. 8, 2011.

(51) Int. Cl.

| | |
|---|---|
| ***A63B 21/008*** | (2006.01) |
| ***A63B 71/06*** | (2006.01) |
| ***A63B 22/00*** | (2006.01) |
| ***A63B 24/00*** | (2006.01) |
| ***A63B 21/00*** | (2006.01) |
| ***A63B 23/04*** | (2006.01) |

(52) U.S. Cl.

CPC ..... *A63B 21/0085* (2013.01); *A63B 21/008* (2013.01); *A63B 21/00069* (2013.01); *A63B 21/0087* (2013.01); *A63B 21/15* (2013.01); *A63B 21/4033* (2015.10); *A63B 21/4034* (2015.10); *A63B 22/0056* (2013.01); *A63B 22/0058* (2013.01); *A63B 23/0405* (2013.01); *A63B 24/0062* (2013.01); *A63B 24/0087* (2013.01); *A63B 71/0619* (2013.01); *A63B 2024/0068* (2013.01); *A63B 2230/75* (2013.01)

(58) Field of Classification Search

CPC ..... A63B 22/04; A63B 22/0056; A63B 23/10; A63B 21/0081; A63B 21/0083; A63B 21/008; A63B 21/0085

USPC ..... 482/51–53, 79–80

See application file for complete search history.

(56) References Cited

U.S. PATENT DOCUMENTS

| | | | | | |
|---|---|---|---|---|---|
| 5,236,407 | A * | 8/1993 | Wang | A63B 22/0056 | 482/113 |
| 5,256,118 | A * | 10/1993 | Chen | A63B 22/0056 | 482/112 |
| 5,267,923 | A * | 12/1993 | Piaget | A63B 21/0085 | 482/52 |
| 5,304,105 | A * | 4/1994 | Hsieh | A63B 22/0056 | 482/111 |
| 5,304,106 | A * | 4/1994 | Gresko | A63B 22/0056 | 482/53 |
| 5,346,444 | A * | 9/1994 | Hsieh | A63B 21/00069 | 482/112 |
| 5,441,466 | A * | 8/1995 | Piaget | A63B 21/0085 | 297/423.46 |

(Continued)

*Primary Examiner* — Andrew S Lo

(74) *Attorney, Agent, or Firm* — Leo Stanger

(57) ABSTRACT

An exerciser, preferably in the form of a stepper with a fluid resistance system guides stepper treadles angularly downward and outward from the center of the stepper. According to an embodiment bellows that support treadles angle downward and outward.

5 Claims, 7 Drawing Sheets

(56) References Cited

U.S. PATENT DOCUMENTS

| | | | | |
|---|---|---|---|---|
| 7,878,949 | B2 * | 2/2011 | Chen | A63B 21/0552 482/52 |
| 2003/0092538 | A1 * | 5/2003 | Kuo | A63B 22/0056 482/79 |
| 2009/0163325 | A1 * | 6/2009 | Piaget | A63B 21/0085 482/53 |
| 2012/0108396 | A1 * | 5/2012 | Chen | A63B 22/00 482/52 |

* cited by examiner

EXERCISE APPARATUS HAVING A TARGETED FLUID SUPPORT SYSTEM

RELATED APPLICATIONS

This is a Division of U.S. application Ser. No. 13/356,468 filed 23 Jan. 2012, which is a Continuation-In-Part of U.S. application Ser. No. 13/113,029 filed 20 May 2011. This application is also related to U.S. application Ser. No. 61/568,619 filed 8 Dec. 2011. Applicant hereby claims the priority dates of these applications. The contents of these applications are hereby made a part of this application as if fully recited herein.

FIELD OF THE INVENTION

This invention relates to exercise devices and methods performed by an exercise apparatuses, and particularly but not exclusively to exercise devices with treadles.

BACKGROUND OF THE INVENTION

Exercise apparatuses, such as stair climbers and steppers, serve to assist the user in performing a desired motion. For example, the exercise apparatuses allow for the proper positioning of the user and proper completion of the user's motion so as to isolate work-out of the desired muscles. Further, such machines serve to support the user to a certain degree to minimize impact during use.

An object of the invention is to improve such devices.

SUMMARY OF EMBODIMENTS OF THE INVENTION

An embodiment of the invention involves an exercise resistance device with depresser plates angled to receive a user's appendages at targeted angles.

A more specific embodiment involves a targeted air support or resistance stepper system with angled treadles that compress bellows connected by air passages.

The various features of novelty that characterize the invention are pointed out in the claims appended to and forming a part of this specification. Other objects and advantages of the invention will become evident from the detailed description when read in light of the following drawings.

DETAILED DESCRIPTION OF PREFERRED EMBODIMENTS

Figure 1:
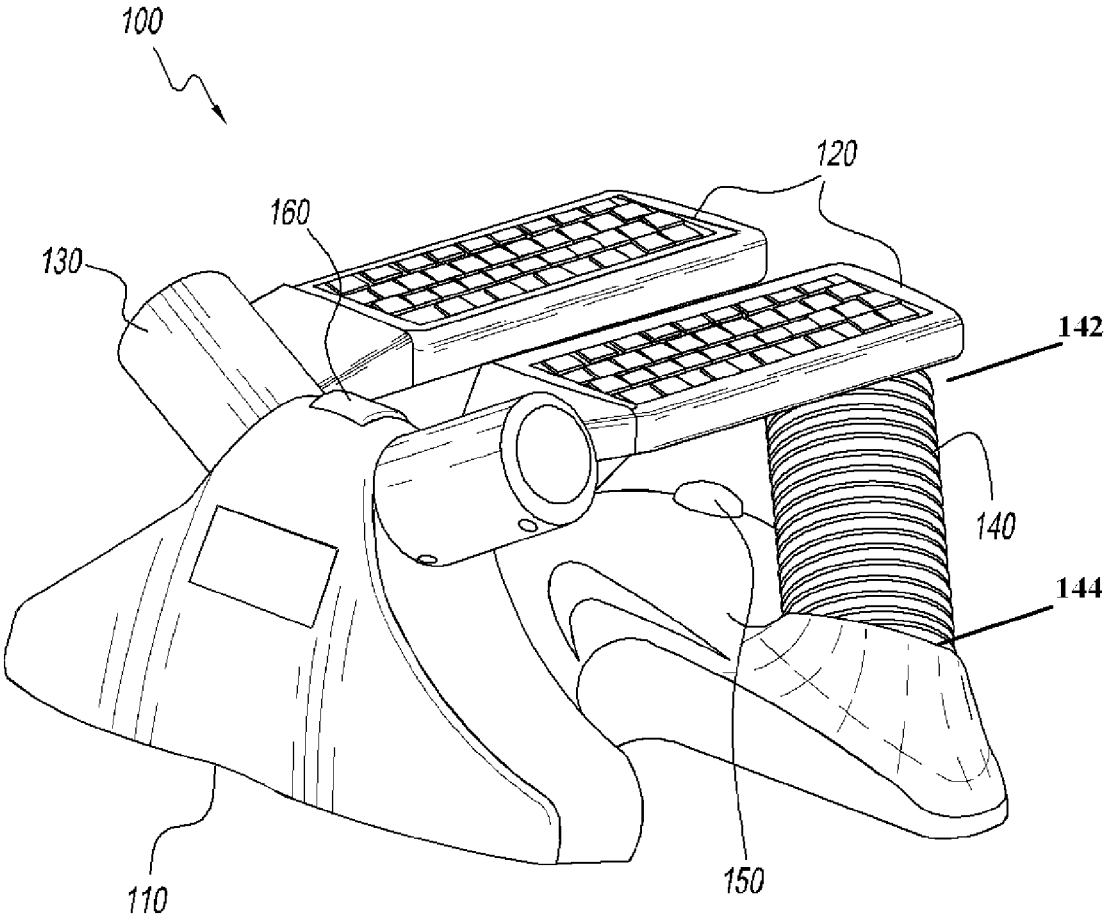
FIG. 1 is a perspective view of an exercise apparatus having an air support system.

FIGS. 1, 2, 2A, 3, and 4 depict embodiments and views of an exercise apparatus 100, such as a stair climber or stepper, having an air support system to assist fluid stepping motion performed by a user. In these Figures the exercise apparatus 100 includes a housing 110, one or more treadles 120, one or more pivots 130, one or more bellows 140, one or more knobs 150, and one or more displays 160. The housing 110 includes a front section 112, a back section 116, and a middle section 114 located between the front section 112 and the back section 116. The back section 116 contains or partially contains an air support system and/or components of the air support system, such as bellows 140. Bellows 140 include a top portion 142 and a bottom portion 144. In the present embodiment of the invention, the back section 116 of the housing 110 is coupled to bottom portion 144 of bellows 140.

In use the bellows 140 deliver pressurized air, or an alternate fluid such as a gas, in a controlled quantity from an air transport pathway to the treadles 120. In the present embodiment, the bellow 140 includes a deformable container and a nozzle or outlet located at the top portion of the bellow 140. When a force is applied to a top portion 142 of the bellow 140, via the vertical motion of the user applied to a treadle 120, the size of the bellow 140 decreases and air escapes through the outlet. This fluid transfer provides a supporting force to the treadles 120 attached to the bellow 140. An inlet is located at a bottom portion 144 of the bellow 140 and coupled to an air transport pathway to facilitate the intake of air into the bellow 140. The bellows 140 is part of an air support system at least partially contained by the housing 110. This air transport system is discussed in greater detail herein.

The front section 112 of housing 110 contains or partially contains pivots 130. In the present example, the front portion 112 of the housing 110 serves to couple to pivots 130 to allow for the clockwise and counterclockwise movement of pivots through a predetermined range. This desired movement facilitates a substantially vertical movement of treadles 120, which are coupled to the pivots 130.

Furthermore, the housing 110 includes and/or contains one or more knobs, such as the knob 150. Knob 150 serves to allow the apparatus user to adjust and control a valve or valves within the bellows 140 transfer components of the air support system contained, at least in part, within the housing 110.

Figure 2:
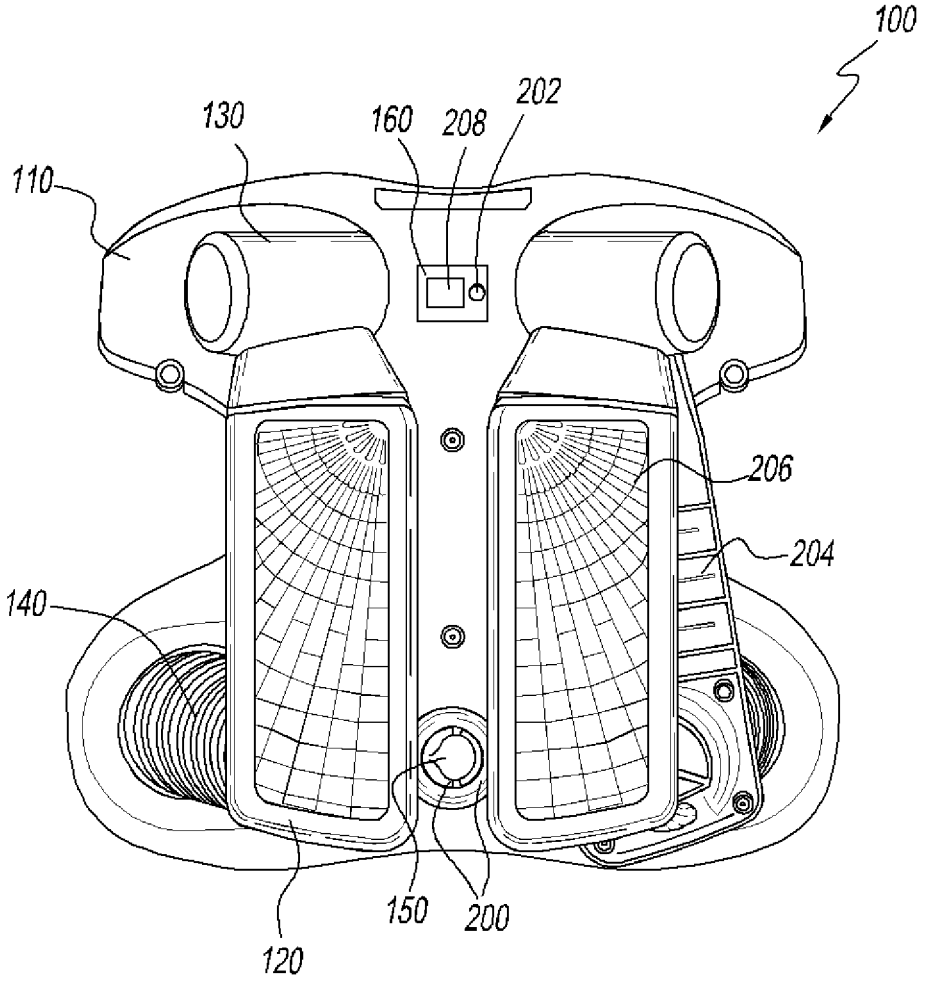
FIG. 2 is a top view of an embodiment of the exercise apparatus of FIG. 1 and also having an air support system.
Figure 2A:
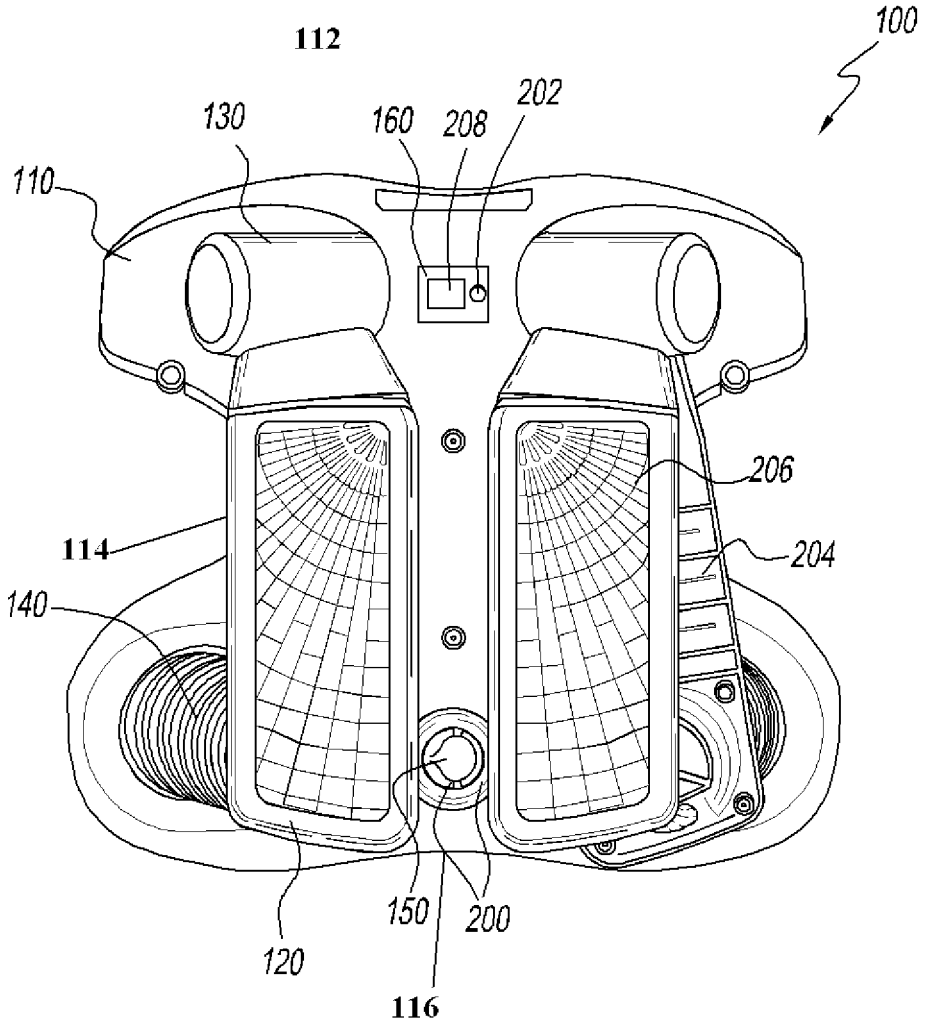
FIG. 2A is a top view of another embodiment of the exercise apparatus of FIG. 1 and also having an air support system

As shown, the treadles 120 are attached to the pivots 130. The treadles 120 are configured to receive an appendage of user, in this case a foot, and may be sized or shaped accordingly. In some examples, the treadles include various tread patterns and/or are sized or shaped to accommodate a foot, such as the right foot or left foot of a user of the exercise apparatus 100. While the present embodiment serves to receive a foot of a user, one of ordinary skill in the art will readily recognize the application of the present invention for use with a hand of a user. In the embodiment of FIG. 2, the treadles 120 include back portions configured to attach to top portions of bellows 140 and front portions configured to attach to pivots 130. In the embodiment of FIG. 2A the back portions 116 form other mechanisms that facilitate a rotation or lateral movement of the treadles 120.

The treadles 120 are attached to the pivots 130 and/or the bellows 140 such that they provide an angled reception surface for a foot of the user when the apparatus is in resting position. The angled attachment may be modified by the user based on the desired comfort angle. In one embodiment, the treadles 120 are angled toward the front section 112 of housing 110, with the rear of treadles 120 at a higher elevation than the front of treadles 120. According to various embodiments this angled surface is accomplished by attaching treadles 120 to angled pivots 130, angled bellows 140, or multiple bellows 140, or by pressurization of bellows 140.

FIG. 2 illustrates a top view of the exercise apparatus 100 having an air support system. As appears in FIG. 1, the exercise apparatus 100 includes a housing 110, one or more treadles 120, one or more pivots 130, one or more bellows 140, one or more knobs 150, and one or more displays 160.

The housing 110, comprised of front section 112, a back section 116, and a middle section 114, contains a knob 150 or other control mechanism(s), electronic or manual, that control, adjust, modify, and/or otherwise operate one or more valves within an air support system contained within the housing 110. Knob 150 serves to facilitate controlling a valve to increase an amount of air taken in by a bellow 140, to decrease an amount of air taken in by a bellow 140, and to modulate between the two. As shown, knob 150 includes predefined setting increments 200 for establishing a certain pressure calibrated to a desired resistance. While four predefined settings are apparent in the present embodiment, one of ordinary skill in the art will readily recognized that any series of control mechanisms may be employed through a range for a myriad of resistance settings as is known in the art.

The housing 110 contains a display 160, such as a digital display 208 that provides information and/or data about an exercise workout sequence performed by a user with the exercise apparatus 100. The display 160, and associated computing system, is capable of tracking and presenting information associated with a number of steps taken during a workout, a duration of a workout, a number of calories burned during a workout, an estimated distance traveled during a workout, a range of values associated with a degree of difficulty of a workout, and so on. Display 160 further includes a status button 202, including an indicator light. Status button 202 serves to perform multiple functions such as the ability to reset the computing system, enter user data, etc. One of ordinary skill in the art will appreciate that the exercise apparatus may include other components and/or devices not shown in the present embodiment, such as a body cord attachment component that facilitates attachment of a body cord to the housing 110. Such body cord attachment, may also allow the transmission of data related to the user exercise regimen to monitor the exercise workout, store data related to the exercise workout, etc.

FIG. 2A shows another embodiment which is a variation of the embodiment in FIG. 2. In the embodiment of FIG. 2A, each treadle 120 includes an upper reception pedal 206 and a lower support pedal 204 both attached to the pivot 130 for vertical movement of the treadle. In each treadle 120 the upper reception pedal 126 lies in one plane and the lower support pedal 124 lies in a plane substantially parallel to the plane of the upper reception pedal. In each treadle 120 one of upper reception pedal 206 and lower support pedal 204 is fixed and the other one of upper reception pedal 206 and lower support pedal 204 is rotatable, relative to the pivot 130, in its own horizontal or near-horizontal plane. This allows the pedals 204 and 206 to move substantially lateral to each other. In the embodiment shown of FIG. 2A, the upper reception pedal 206 of a treadle 120 is fixed and the lower support pedal 204 of the same treadle 120 is movable to the right. In another embodiment the upper reception pedal 206 of a treadle 120 is movable and the lower support pedal of the same treadle 120 is fixed. Such substantially horizontal movement of the reception pedals 206 or substantially horizontal movement of the support pedals 204 permits the back ends 124 in each treadle 120 to separate and come together rotationally and thereby to allow for a narrow user stance or a broad user stance as desired by the user for the user's comfort. Further, such horizontal lateral movement between upper reception pedal 206 and lower support pedal 204 facilitates alternate muscle toning capabilities for the user.

Figure 3:
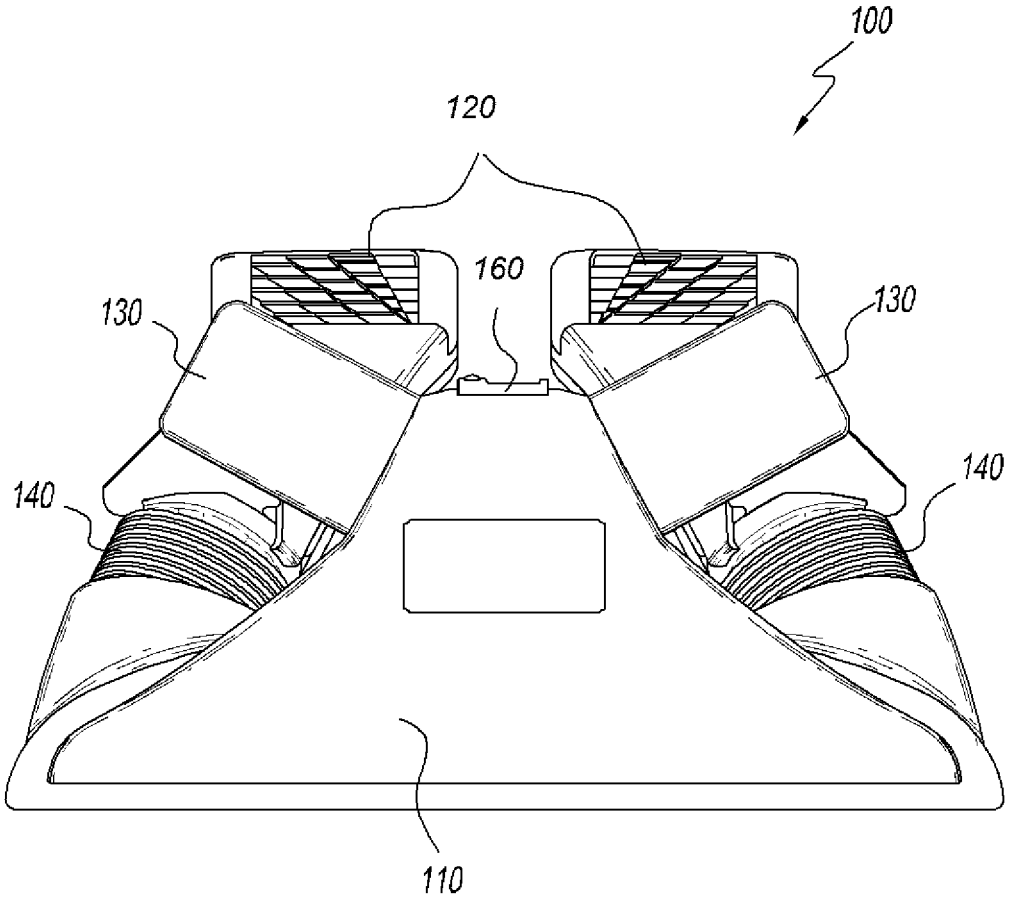
FIG. 3 is a front view of the exercise apparatus of FIG. 1 and also having an air support system.

FIG. 3 is a front view of the exercise apparatus 100 having an air support system and uses the same reference numerals as in FIG. 1. In FIG. 3 the exercise apparatus 100 includes a housing 110, one or more treadles 120, one or more pivots 130, one or more bellows 140, one or more knobs (not shown), and one or more displays 160. In the embodiments shown, the housing 110 is manufactured of substantially rigid material to sustain the forces applied by a user of various weight ranges. Further, the housing 110 is substantially weighted to control movement of the exercise apparatus 100 while in use. As one of ordinary skill in the art will readily recognize, a workout regimen by a user of a "stepping device" places substantial forces at various angles and such a device must be able to withstand such applied forces, and to some degree counter such forces, while minimizing the travel of the housing 110 on the surface on which the exercise apparatus 100 stands. In addition to substantial weighting of the exercise apparatus 100, an embodiment of the invention involves using appliqués on the bottom of the housing 110 for use on a rough flooring such as a carpeted flooring, and another embodiment involves attaching suctioning devices to the bottom of the housing for use on a smooth surface flooring such as a wooden floor, to increase the static friction of the exercise apparatus 100 depending on the surface on which the exercise apparatus 100 stands.

Figure 4:
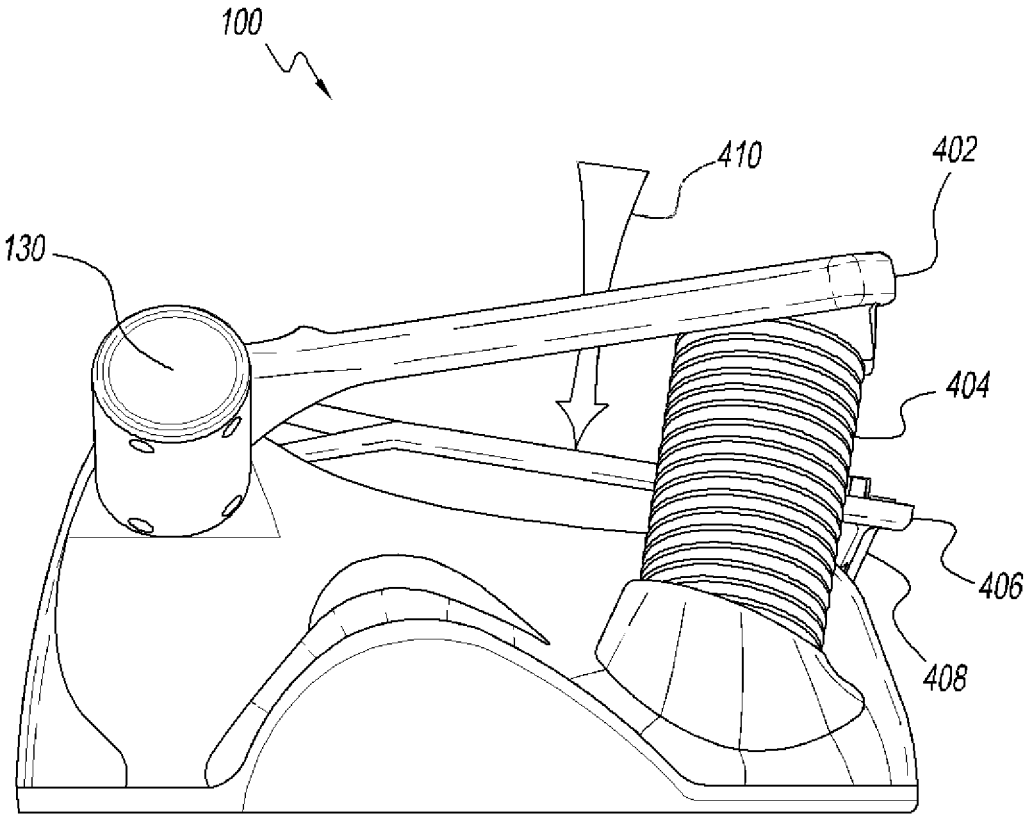
FIG. 4 is a side view of the exercise apparatus of FIG. 1 and also having an air support system.

FIG. 4 depicts a side view of the exercise apparatus 100 having an air support system. In the present embodiment, exercise apparatus 100 is shown in an "active state". Here a first force 410 is applied to a treadle 406 (corresponding to a treadle 120) connected to the pivot 130, for example by a user's foot (not shown). This force compresses bellow 408 (corresponding to a bellow 140) and forces fluid transfer of air through an air support system. The transfer of air from bellow 408 results in an increased pressure in bellow 404 (also corresponding to a bellow 140) and produces an upward force, or support force, to raise a treadle 402 (also corresponding to a treadle 120) connected to the pivot 130. This effectively creates an upward force on the user's other foot (not shown). In turn, once a user of exercise apparatus 100 applies a downward force to treadle 402, bellow 404 will compress and transfer air through the air support system to bellow 408 thereby raising treadle 406. Such transfer of force mimics the repetitious "stepping" action desired.

While two bellows integrated as part of an air compression system are disclosed, it is readily apparent that independent bellows may be employed.

Figure 5:
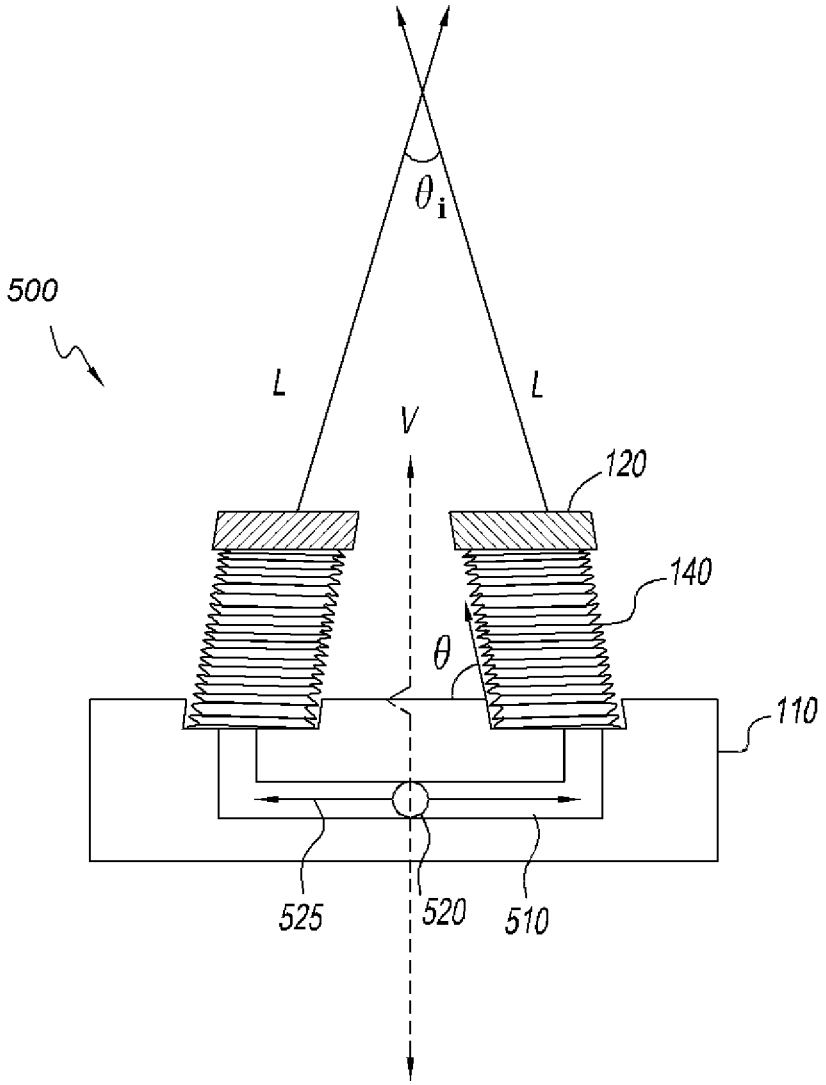
FIG. 5 is a schematic diagram of an air support system.

Further detail of the air support system of the exercise apparatus appears in FIG. 5. This figure shows a schematic diagram of an air support system 500 having angled support bellows. The air support system 500 includes bellows 140 having top portions attached to treadles 120 of an exercise apparatus and bottom portions attached to the housing 110 of the exercise apparatus 100. The air support system 500 supports movement of treadles 120 of the exercise apparatus, providing a one- or two-dimensional support force to a treadle as the treadle moves down towards the housing 110 of the exercise apparatus. That is, the air support system may receive a force at a first treadle of the exercise apparatus; and transfer the received force to a second treadle of the exercise apparatus, such as via an angled bellow or multiple bellows, thereby facilitating application of a targeted and/or two-dimensional force on a treadle moving downwards or upwards during operation of the exercise apparatus. The air support system 500 also includes a sealed air transfer pathway, conduit, or component 510 that contains air 525 and a valve 520 that controls the flow of air within the air transfer pathway 510.

In the present embodiment, the air transfer pathway 510 is coupled to an inlet component of a bellow 140, which facilitates the input of air 525 from the air transfer pathway 510 to the bellow 140. In some embodiments, the air pressure within the bellows 140 and/or air transfer pathway 510 are controlled by the valve 520, which is connected to a knob, such as the knob 150, to regulate resistance and calibrate the exercise apparatus, or other component of the housing 110. This enables a user to adjust the valve 520 and the air pressure within the bellows 140.

In the present embodiment, the air transfer pathway 510 facilitates the transfer of forces between treadles 120, such as between a right treadle and a left treadle. That is, a downward force received at a right treadle, such as a force caused by a foot of a user stepping down on the right treadle, may cause air 525 to leave an associate bellow 140, travel through the air transfer pathway 510, and apply a support force, such as a two-dimensional force, to the left treadle.

In some embodiments, the bellows 140 are configured and/or positioned at an angle $\theta_i$ with respect to a vertical axis V of the housing 110 of the exercise apparatus. That is, a bellow or bellows 140 are positioned such that an angle θ formed between a longitudinal axis L of a bellow 140 and the plane of the housing 110 of the exercise apparatus 100 is less than 90 degrees. In some cases, the angle θ is an acute angle, such as an angle between 90 and 60 degrees.

In these embodiments, the bellows 140 are configured such that a longitudinal axis L of the right bellow and a longitudinal axis L of the left bellow intersect one another. In one embodiment of the present invention, the intersection of inner angle $\theta_i$ is 45 degrees or less.

The angled bellows 140 provide various targeted support forces to treadles 120, such as support forces having vertical and horizontal components. For example, an angled bellow facilitates application of a first dimensional component of a support force and a second dimensional component of the support force to a treadle, among other things.

Although shown in FIG. 5 as being at a fixed angle, according to an embodiment, the angle of attachment of the bellows 140 is adjustable. For example, the treadle 120 includes a coupling component that facilitates user adjustment of the angle θ of one or both bellows 140. Thus, a user may wish to make adjustments during a workout, by changing the angle of one or both bellows 140 to enhance comfort, target certain muscles.

Additionally and/or alternatively, in some embodiments the air support system may support treadles of an exercise apparatus via two or more bellows, such as bellows 140.

Figure 6:
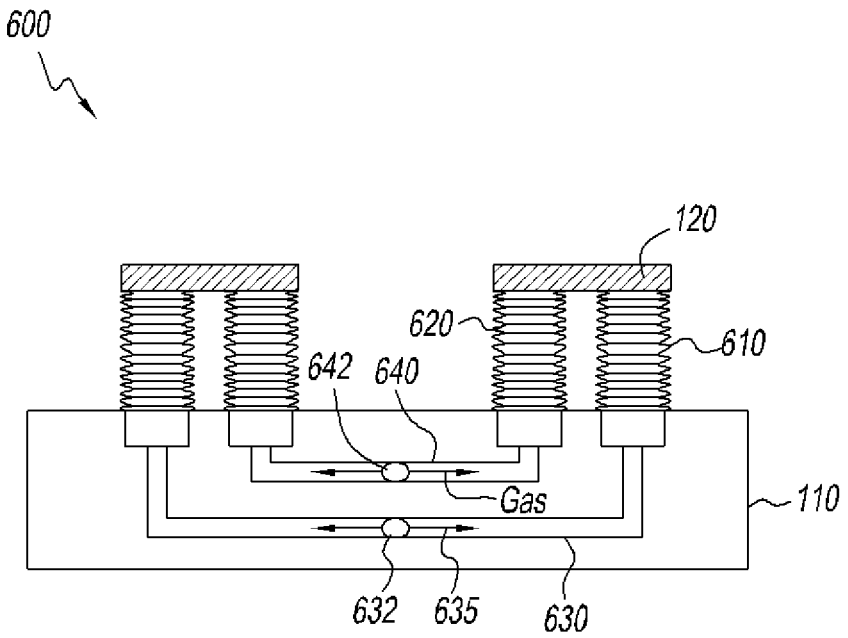
FIG. 6 is a schematic diagram of an air support system having multiple support portions.

FIG. 6 is a schematic diagram of an air support system 600 having multiple support bellows. The air support system 600 includes outer bellows 610 coupled to outer portions of treadles 120 and inner bellows 620 coupled to inner portions of the treadles 120. The outer bellows 610 are coupled to a first air transfer pathway 630 that contains a valve 632 and compressed air 635. Similarly, the inner bellows 620 are coupled to a second air transfer pathway 640 that contains a valve 642 and compressed air 645.

In an embodiment, the outer bellows 610 are taller and expand to a greater degree than the inner bellows 620. This allows an attached treadle 120 to provide an angled support surface, among other benefits. In some embodiments, the first air transfer pathway 630 is set at a higher pressure than the second air transfer pathway 640. In some embodiments, the first air transfer pathway 630 is set at a lower pressure than the second air transfer pathway 640. A knob, such as the knob 150, of the housing 110 controls valve 635 and/or valve 645, in order to adjust the air pressure within one or both air transfer pathways 630, 640.

Thus, in alternate embodiments, use of two or more bellows 610, 620 facilitates the application of targeted support forces, such as a first force at an outer portion of a treadle and a second, optionally different, force at an inner portion of the treadle. These targeted support forces provide enhanced support and/or comfort for a user of an exercise apparatus, and provide a modified or targeted workout, among other benefits.

Figure 7:
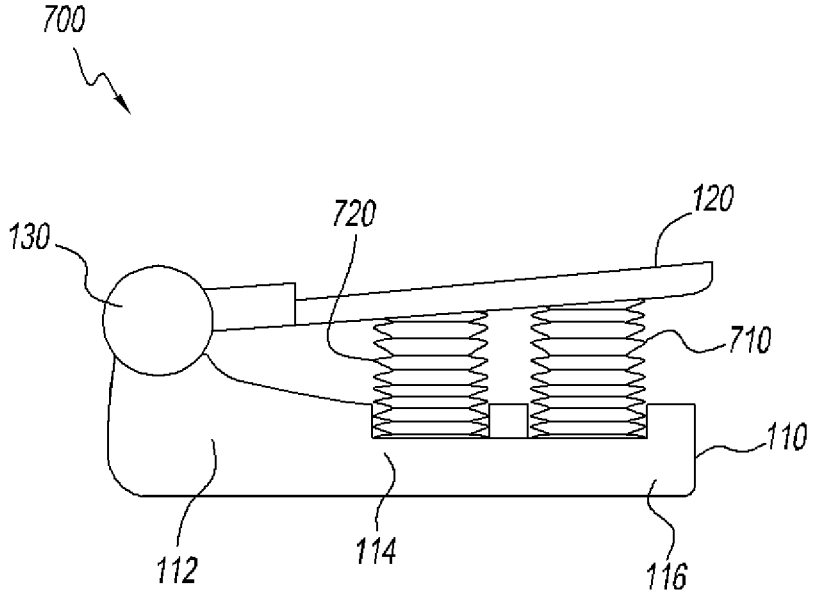
FIG. 7 is a side view of an exercise apparatus having multiple support bellows.

In some embodiments, two or more bellows are positioned to provide support at various locations along a treadle. FIG. 7 shows a side view of an exercise apparatus 700 having multiple support bellows. The exercise apparatus 700 includes a back bellow 710 located at a back portion 116 of a housing 110 and a middle bellow 720 located at a middle portion 114 of the housing 110. As discussed with the air support system 600, the exercise apparatus 700 may include two or more air transfer pathways, each associated with a set of bellows, such as back bellows 710 and/or middle bellows 720.

During use of the exercise apparatus 700, the back bellows 710 provide a first support force to treadles, and the middle bellows 720 provide a second, and different, support force to the treadles. For example, the back bellows 710 may provide a support force that is lower than a support force provided by the middle bellows 720. The variable support forces may provide enhanced comfort to a user, may provide a workout targeted to specific muscle groups, such as muscle groups within a user's legs, among other benefits.

In some embodiments, an exercise apparatus, such as exercise apparatus 100 or 700, utilizes a support system that relies on fluids other than air to provide support to a user of the exercise apparatus. In one embodiment a fluid support system includes a hydraulic fluid and/or other compressible or incompressible fluids.

Various embodiments of an exercise apparatus having an air support system are described. In some embodiments, the exercise apparatus provides targeted support to a user of the exercise apparatus via angled bellows and/or multiple bellows, among other things.

As shown, embodiments of the exercise apparatus take the form of a climbing or stepping apparatus, which employs a targeted air support or resistance system. In some implementations, the exercise apparatus includes an air support system configured to provide two-dimensional supporting or resistance forces during use of the exercise apparatus.

Depending on the particular embodiment disclosed, a single bellow configured to support a single treadle of the exercise apparatus is positioned and/or attached at various angles. Such configuration serves to facilitate the application of two-dimensional forces to the treadles.

In alternate disclosed embodiments, two or more bellows configured to support treadles of the exercise apparatus are positioned and/or attached to the treadles. In an embodiment the bellows are attached next to one another at one section of a treadle, and/or in another embodiment are attached next to one another along the length of the treadle. This facilitates the application of two-dimensional forces to the treadles.

Thus, the present apparatus or device described herein provides targeted support to a user of an exercise apparatus. Such targeted support offers improved or enhanced support to the user during exercise, to assist in exercising certain muscle groups, to adjust or modify a workout.

A detailed description of the aforementioned embodiments of the present invention is disclosed. However, techniques of manufacture and resulting structures in accordance with the present invention may be embodied in a wide variety of forms and modes, some of which may be quite different from those in the disclosed embodiment. Consequently, the specific structural details disclosed herein are merely representative, yet in that regard, they are deemed to represent suitable implementations for purposes of disclosure and to provide a basis for the claims herein, which define the scope of the present invention. The above presents a detailed description of several examples of the present invention.

Moreover, well known methods, procedures, and substances for both carrying out the objectives of the present invention and illustrating the preferred embodiment are incorporated herein but have not been described in detail as not to unnecessarily obscure novel aspects of the present invention.

The figures of various implementations set forth in the illustrations serve for an understanding of the present invention and objectives other than those set forth above. Although the shown implementations illustrate certain aspects of the present invention, the apparatus and method of use of the invention, in general, together with further objectives and advantages thereof, may be more easily understood by reference to the drawings, examples, and the above description. The examples and figures are not intended to limit the scope of this invention, which is set forth with particularity in the claims as appended or as subsequently amended, but merely to clarify and exemplify the invention.

The invention contrasts with other air compression systems that provide minimal operational improvement over mechanical based support systems in other exercise apparatuses. Generally, such air compression systems merely facilitate up and down motion of a user.

While certain aspects of the device are presented below in certain claim forms, the inventor contemplates the various aspects of the system in any number of claim forms. Accordingly, the inventor reserves the right to add additional claims after filing the application to pursue such additional claim forms for other aspects of the system.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the Detailed Description using the singular or plural number may also include the plural or singular number respectively. The word "or," in reference to a list of two or more items, covers all of the following interpretations of the word: any of the items in the list, all of the items in the list, and any combination of the items in the list. The term "air" as used herein is intended to include not just air but any gas.

Thus, there has been summarized and outlined, generally in broad form, a plurality of the most important features of the present invention. While this summary is presented so that the novelty of the present contribution to the related art may be better appreciated, it will further be apparent that additional features of the invention described hereinafter (which will form the subject matter of the claims appended hereto) will further define the scope, novelty, and in certain instances the improvements upon any existing art. The above description provides specific details for a thorough understanding of, and enabling description for, various examples of the technology. One skilled in the art will understand that the technology may be practiced without many of these details and it is to be readily understood that the invention presented herein is not limited in its application to the details of construction and to the arrangements of the components set forth in the following description or illustrated in the various figures integrated and categorized herein. For example, in some instances, well-known structures and functions have not been shown or described in detail to avoid unnecessarily obscuring the description of the examples of the technology. It is intended that the terminology used in the description presented below be interpreted in its broadest reasonable manner, even though it is being used in conjunction with a detailed description of certain examples of the technology. Although certain terms may be emphasized below, any terminology intended to be interpreted in any restricted manner is overtly and specifically defined as such in this Detailed Description section. Those skilled in the art will appreciate that the disclosure of the present invention may readily be utilized as a basis for forming other similar structures, methods and systems for carrying out the various purposes and objectives of the present invention. Thus, the claims as set forth shall allow for such equivalent constructions insofar as they do not depart from the spirit and scope of the present invention as described herein.

What is claimed is:

1. A method performed by an exercise apparatus for a user of the exercise apparatus, the method comprising:

receiving a first received force at a first depresser of the exercise apparatus with the first depresser responding to the first received force by traveling along a first path;

receiving a second received force at a second depresser of the exercise apparatus with the second depresser responding to the second received force by traveling along a second path;

transferring the first received force to the second depresser of the exercise apparatus via an air support system and transferring the second received force to the first depresser via the air support system;

wherein the first path occurs along a first angle and the second path occurs along a second angle, and said first and second angles intersect.

2. The method as in claim 1, wherein transferring the first received force to the second depresser includes transferring a first dimensional component of a support force as a first support force to the second depresser at the first angle via a first angled support bellow and transferring a second dimensional component of the support force as the second support force to the second depresser at the second angle via a second angled support bellow, said first support bellow and said second support bellow being compressed along intersecting angles.

3. The method as in claim 1, wherein transferring the first received force to the second depresser includes transferring a first support force to the second depresser via a first support bellow and transferring the second received force to the first depresser includes transferring a second support force to the first depresser via a second support bellow.

4. A method performed by an exercise apparatus for a user of the exercise apparatus, the method comprising:

receiving a force at a right depresser of the exercise apparatus from the user of the exercise apparatus;

receiving a force at a left depresser of the exercise apparatus from the user of the exercise apparatus;

resisting the force at the right depresser with a right force resistor having a right top portion attached to the right depresser acting along a first longitudinal axis at a first acute angle;

resisting the force at the left depresser with a left force resistor having a left top portion attached to the left depresser acting along a second longitudinal axis at a second acute angle that intersects with the first longitudinal axis.

5. A method performed by an exercise apparatus for a user of the exercise apparatus, the method comprising:

receiving a force at a pedal upon a treadle of a right depresser of the exercise apparatus from the user of the exercise apparatus;

receiving a force at a pedal upon a treadle of a left depresser of the exercise apparatus from the user of the exercise apparatus;

resisting the force at the right depresser with a right force resistor;

resisting the force at the left depresser with a left force resistor;

moving the pedal upon the treadle of the right depresser in a plane parallel to a plane of the treadle of the right depresser in response to the force at the pedal of the right depresser;

moving the pedal upon the treadle of the left depresser in a plane parallel to a plane of the treadle of the left depresser in response to the force at the pedal of the left depresser;

wherein the pedal upon the treadle of the right depresser moves pivotally in the plane of the treadle of the right depresser;

wherein the pedal upon the treadle of the left depresser moves pivotally in the plane of the treadle of the left depresser;

wherein resisting the force upon the right depresser includes resisting the force at the right depresser with a right force resistor having a right top portion attached to the pedal of the right depresser acting along a first longitudinal axis at a first acute angle; and wherein resisting the force at the left depresser with a left force resistor having a left top portion attached to the pedal of the left depresser acting along a second longitudinal axis at a second acute angle that intersects with the first longitudinal axis.

* * * * *